US005639007A

United States Patent [19]

Nakamura

[11] Patent Number: 5,639,007

[45] Date of Patent: Jun. 17, 1997

[54] STAPLER WITH INDICATOR ASSEMBLY FOR INDICATING AND DISPENSING STAPLES OF DIFFERENT SIZES

[75] Inventor: Yasuhiko Nakamura, Abiko, Japan

[73] Assignee: Maruzen Kabushiki Kaisha, Tokyo, Japan

[21] Appl. No.: 410,704

[22] Filed: Mar. 27, 1995

Related U.S. Application Data

[63] Continuation-in-part of Ser. No. 110,440, Aug. 23, 1993.

[30] Foreign Application Priority Data

Aug. 24, 1992 [JP] Japan ..... 4-223746

[51] Int. Cl.[6] ..... B25C 5/16

[52] U.S. Cl. ..... 227/109; 227/119; 227/120; 227/137

[58] Field of Search ..... 227/109, 119, 227/137, 120; 269/293, 303, 304; 83/468.5

[56] References Cited

U.S. PATENT DOCUMENTS

| | | | |
|---|---|---|---|
| 1,907,849 | 5/1933 | Maynard | 227/109 |
| 1,983,398 | 12/1934 | Polzer | 227/109 |
| 2,332,257 | 10/1943 | Polzer | 227/109 |
| 5,096,109 | 3/1992 | Chen | 227/109 |

FOREIGN PATENT DOCUMENTS

| | | | |
|---|---|---|---|
| 180568 | 7/1990 | Japan | 227/109 |
| 2165793 | 4/1986 | United Kingdom | 227/109 |

*Primary Examiner*—Rinaldi I. Rada
*Assistant Examiner*—Boyer Ashley
*Attorney, Agent, or Firm*—Morrison Law Firm

[57] ABSTRACT

A stapler includes a staple magazine rotably connected to an operating assembly. The operating assembly rotates around a shaft in response to pressure applied by a user to a operating handle. The staple magazine includes a plurality of staple clips capable of holding different size staples. The stapler includes means for determining a desired staple size. The staple magazine is rotated by the user to select a desired size staple. A stopper assembly, slidably mounted on a base of the stapler, is positioned by the user to limit and guide a front edge of a stack of papers being stapled. The means for determining a desired staple size and the stopper assembly are free from interference with each other. The stopper assembly is constructed so that a portion contacting the front edge of the stack of papers remains perpendicular to the front edge during a stapling operation.

3 Claims, 12 Drawing Sheets

STAPLER WITH INDICATOR ASSEMBLY FOR INDICATING AND DISPENSING STAPLES OF DIFFERENT SIZES

This is a continuation-in-part of U.S. Ser. No. 08/110,440 filed Aug. 23, 1993, and entitled STAPLER FOR DISPENSING STAPLES OF DIFFERENT SIZES, still pending.

BACKGROUND OF THE INVENTION

The present invention relates to a stapler with a magazine containing strips of differently sized staples. More particularly, the present invention relates to a stapler which determines an appropriately sized staple needed to staple a given stack of paper.

Japanese Laid-Open Patent Publication No. 180568/1990 discloses a stapler which dispenses staples of different sizes. The stapler also determines an appropriately sized staple by moving a swinging frame against a top of the stack of paper to be stapled. A bottom of a staple magazine presses against a receiving lever located on a stapler body base. Pressing the receiving lever down causes a pointer of a movable gauge piece to move upward and point to a display panel of a fixed gauge plate. A stopper assembly severely limits possible stapling points on the stack of paper due to interference by the receiving lever. A drawback of this prior art stapler is that the location of the receiving lever limits a range of available locations on the stack of paper where the staple may be placed.

OBJECTS AND SUMMARY OF THE INVENTION

Accordingly, it is an object of the present invention to provide a stapler which overcomes the drawbacks of the prior art.

It is another object of the present invention to provide a stapler which determines a properly sized staple for a thickness of a stack of paper to be stapled.

It is a further object of the present invention to provide a stapler which staples the stack of paper at any location without interference from the mechanism used to determine the properly sized staple.

Briefly stated, a stapler includes a staple magazine rotably connected to an operating assembly. The operating assembly rotates around a shaft in response to pressure applied by a user to a operating handle. The staple magazine includes a plurality of staple clips capable of holding different size staples. The stapler includes means for determining a desired staple size. The staple magazine is rotated by the user to select a desired size staple. A stopper assembly, slidably mounted on a base of the stapler, is positioned by the user to limit and guide a front edge of a stack of papers being stapled. The means for determining a desired staple size and the stopper assembly are free from interference with each other. The stopper assembly is constructed so that a portion contacting the front edge of the stack of papers remains perpendicular to the front edge during a stapling operation.

According to an embodiment of the invention, a stapler includes means for driving a staple, means for determining a properly sized staple to penetrate and staple an object, means for selecting the properly sized staple from a magazine containing at least two differently sized staples, a stopper assembly, the determining means and the stopper assembly being free from interference with each other, means for slidably engaging the stopper assembly with a base of the stapler, means for maintaining the stopper assembly in a vertical position during a stapling operation.

The above, and other objects, features, and advantages of the present invention, will become apparent from the following description read in conjunction with the accompanying drawings, in which like reference numerals designate the same elements.

DETAILED DESCRIPTION OF THE PREFERRED EMBODIMENT

Figure 1:
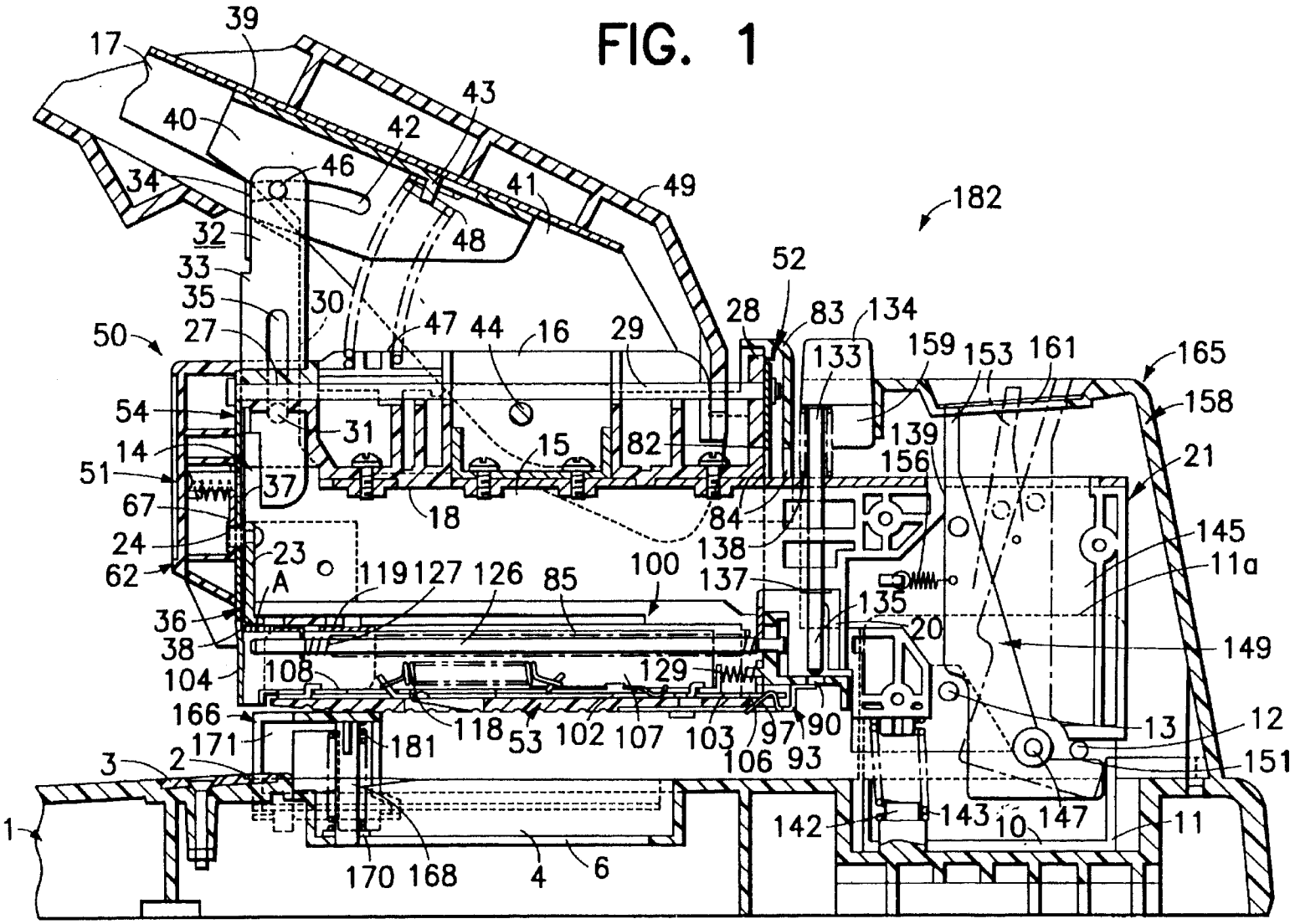
FIG. 1 is a cross section view of a stapler according an embodiment of the present invention.

Referring to FIGS. 1–3 and 13, a stapler 182 includes a body base 1 with an anvil plate 3 secured by a fastener. Anvil plate 3 includes an anvil indentation 2 for curling two prongs of a staple (not shown) during stapling. A top of anvil plate 3 is flush with an upper surface of body base 1. A center guide recess 4, laterally centered in body base 1, extends rearward from near anvil plate 3. (Looking at FIG. 1, "forward" refers to a leftward direction of stapler 182 and "rearward" refers to a rightward direction.)

A mounting recess 10 in body base 1 receives a mounting bracket 11 which includes a pair of parallel mounting plates 11*a*. A rod-shaped stopper 12, laterally positioned between mounting plates 11*a*, is secured by conventional fasteners such as screws or flanged ends. A rotational shaft 13 extends through a pair of holes 13*a* in mounting plates 11*a* and is preferably secured by screws and washers. Stopper 12 and rotational shaft 13 secure mounting plates 11*a* at their lower rear and upper front portions, respectively.

An operating arm 15 includes a top plate 18 and two side plates 19. Operating arm 15 is preferably integrally formed of metal or plastic. Each side plate 19 includes a mounting base 20. A pair of holes 13*b* in mounting base 20 align with holes 13*a* in mounting plates 11*a* through which rotational shaft 13 extends. Operating arm 15 thus partially rotates around mounting bracket 11 on rotational shaft 13.

Figure 12:
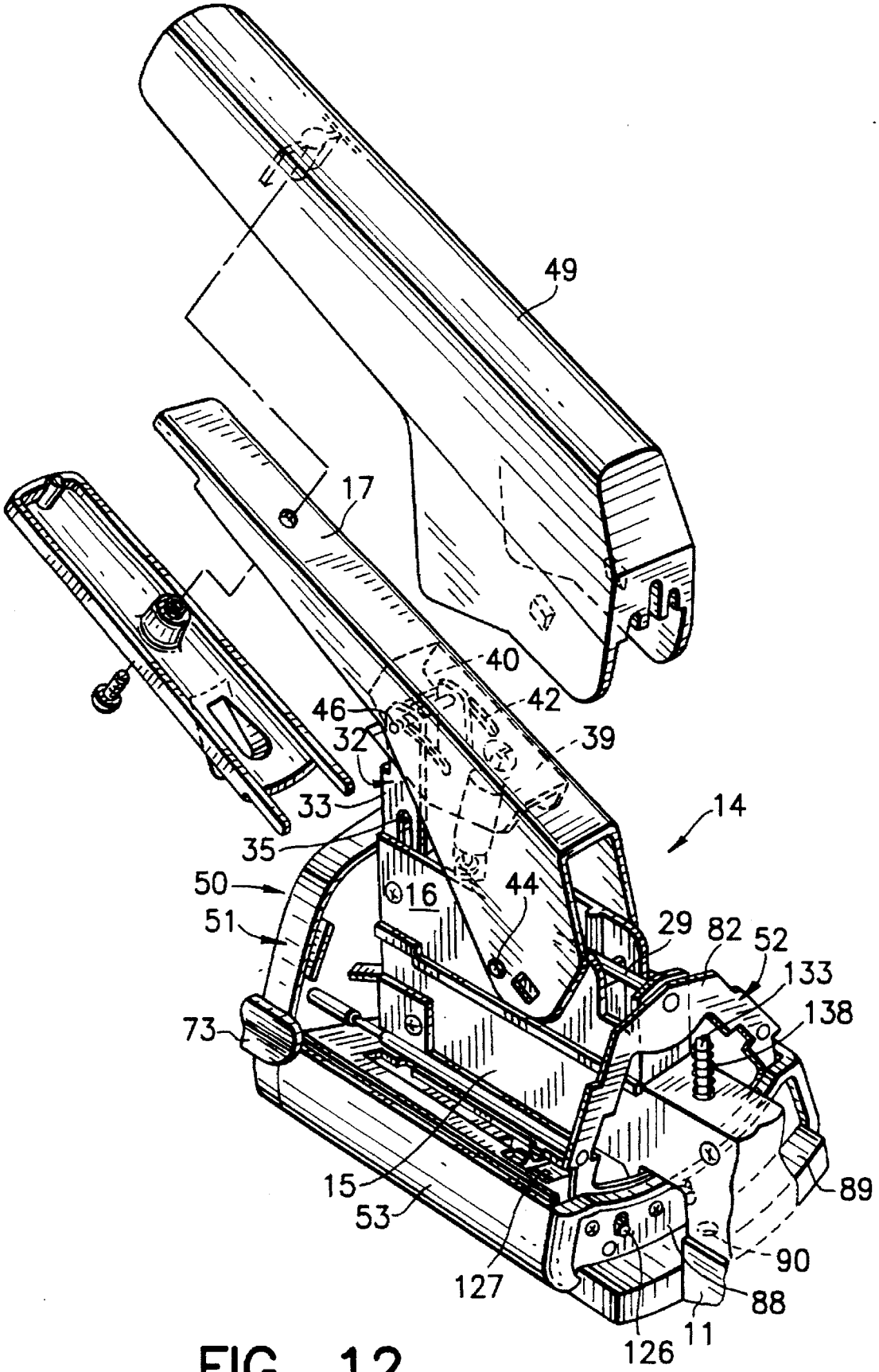
FIG. 12 is an exploded perspective view of the staple container and an operating assembly according to the present invention.

Referring also to FIG. 12, operating arm 15, along with a mounting frame 16 and an operating handle 17, comprise operating assembly 14. A staple container 50 is connected to operational assembly 14. Mounting frame 16 is secured to top plate 18 of operating arm 15 by conventional fasteners. Mounting frame 16 is made of any convenient material such as, for example, a synthetic resin. Operating handle 17 is rotatably attached to mounting frame 16 by a rotational shaft 44. Operating handle 17 is upwardly biased by a coil spring 48 which extends between a stopping ridge 47 on mounting frame 16 and a stopper 43 on operating handle 17. Stapling with stapler 182 is a two step operation. In the first step, a user pushes operating handle 17 downward, thereby rotating operational assembly 14 about rotational shaft 13. In the second step, when operational assembly 14 ceases rotating due to staple container 50 making contact with either anvil plate 3 or an object interposed therebetween, additional force applied to operating handle 17 overcomes a spring force of coil spring 48, thereby rotating operating handle 17 around rotational shaft 44 to commence a stapling action. As explained below, the first step of rotating operational assembly 14 indicates a desired size staple, and the second step inserts the staple into the object being stapled.

Figure 3:
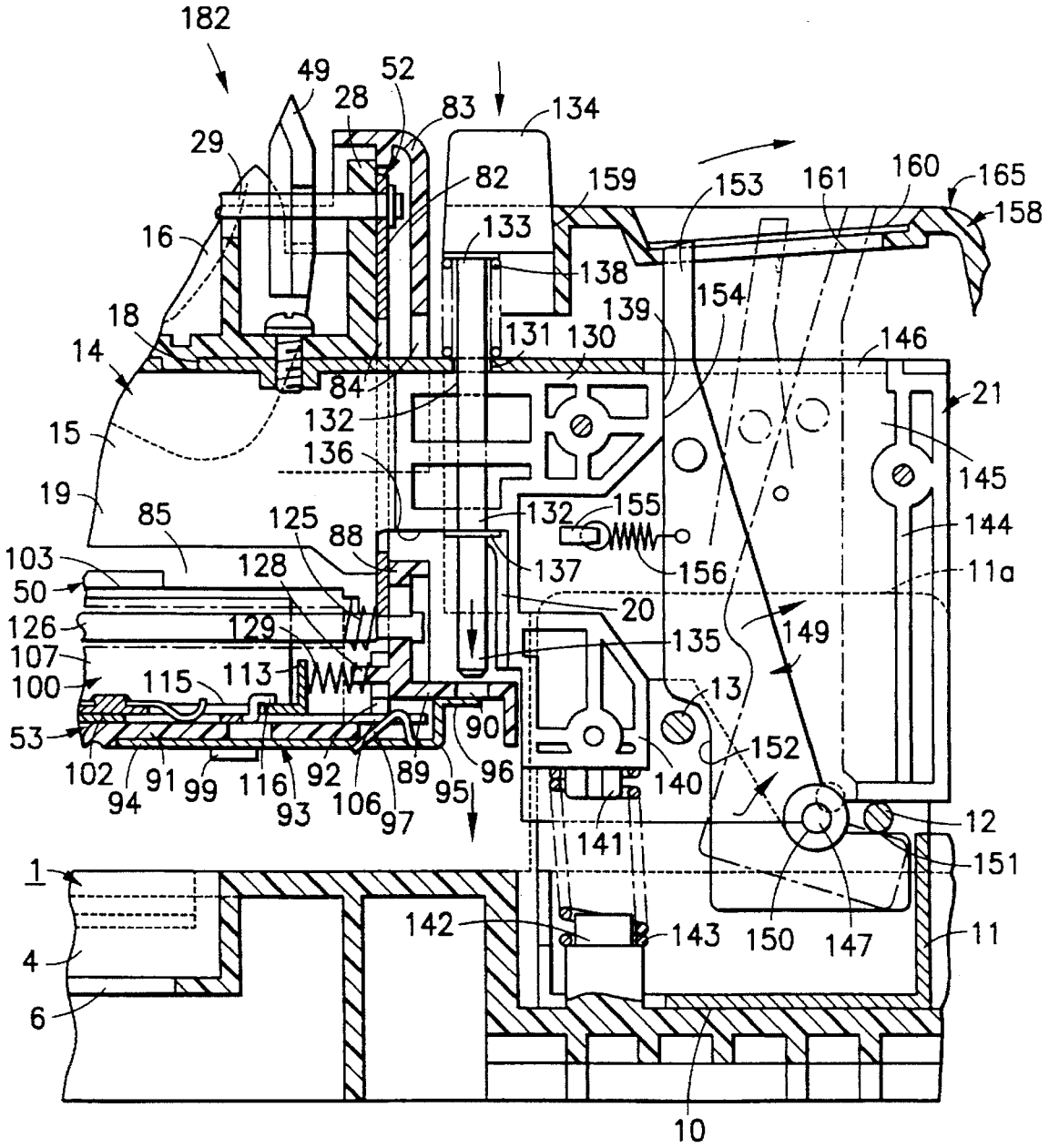
FIG. 3 is an enlarged partial cross-section view of a rear portion of the stapler of FIG. 1.
Figure 4:
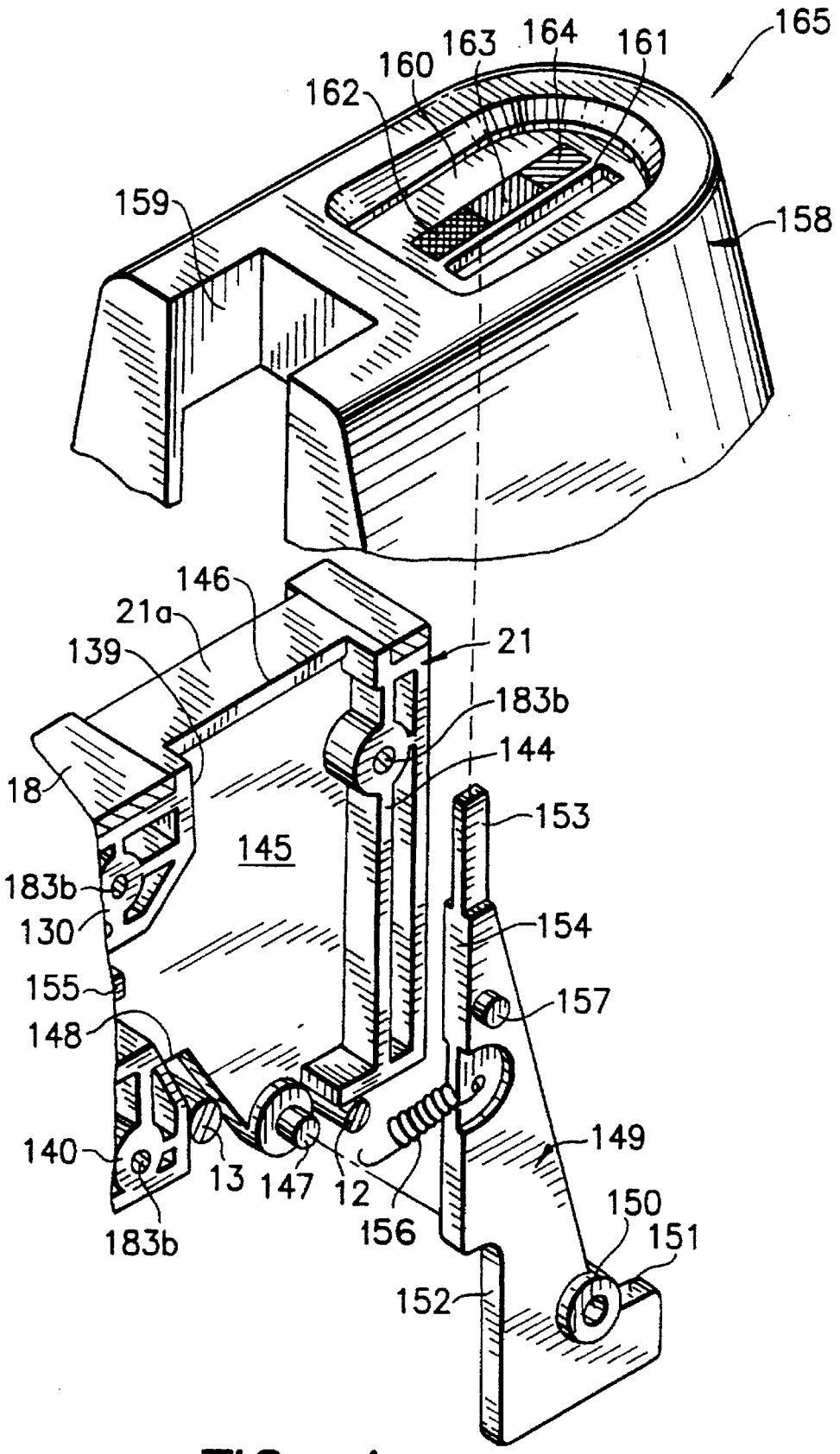
FIG. 4 is an exploded partial perspective view of an indicator assembly of the stapler of FIG. 1.
Figure 5:
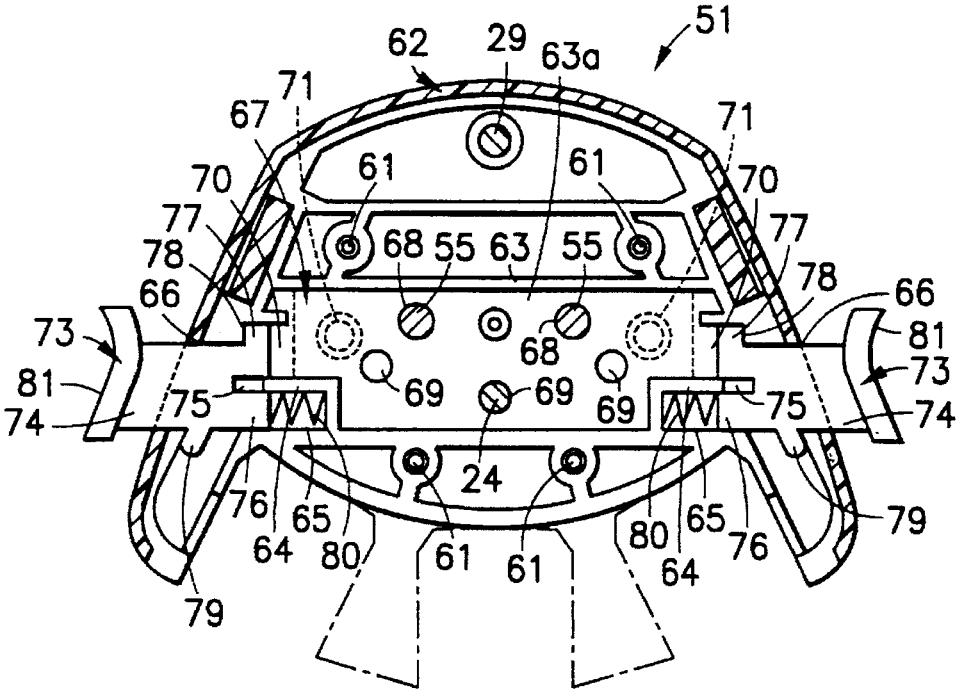
FIG. 5 is a cross-section view of a staple container according to an embodiment of the present invention.
Figure 6:
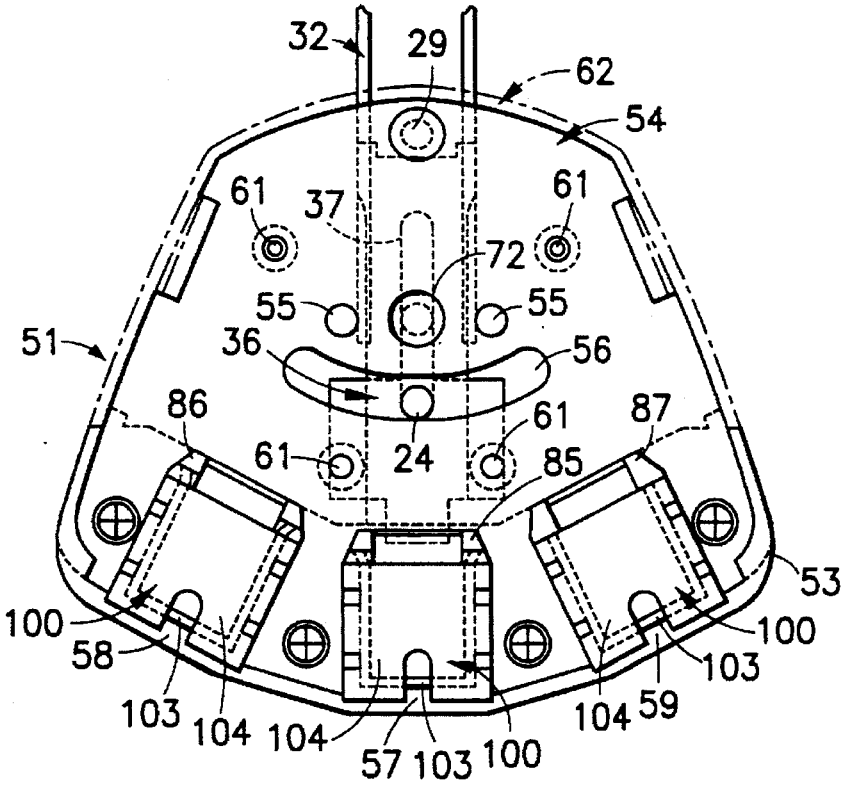
FIG. 6 is a cross-section view of the staple container according to the embodiment of FIG. 5.
Figure 13:
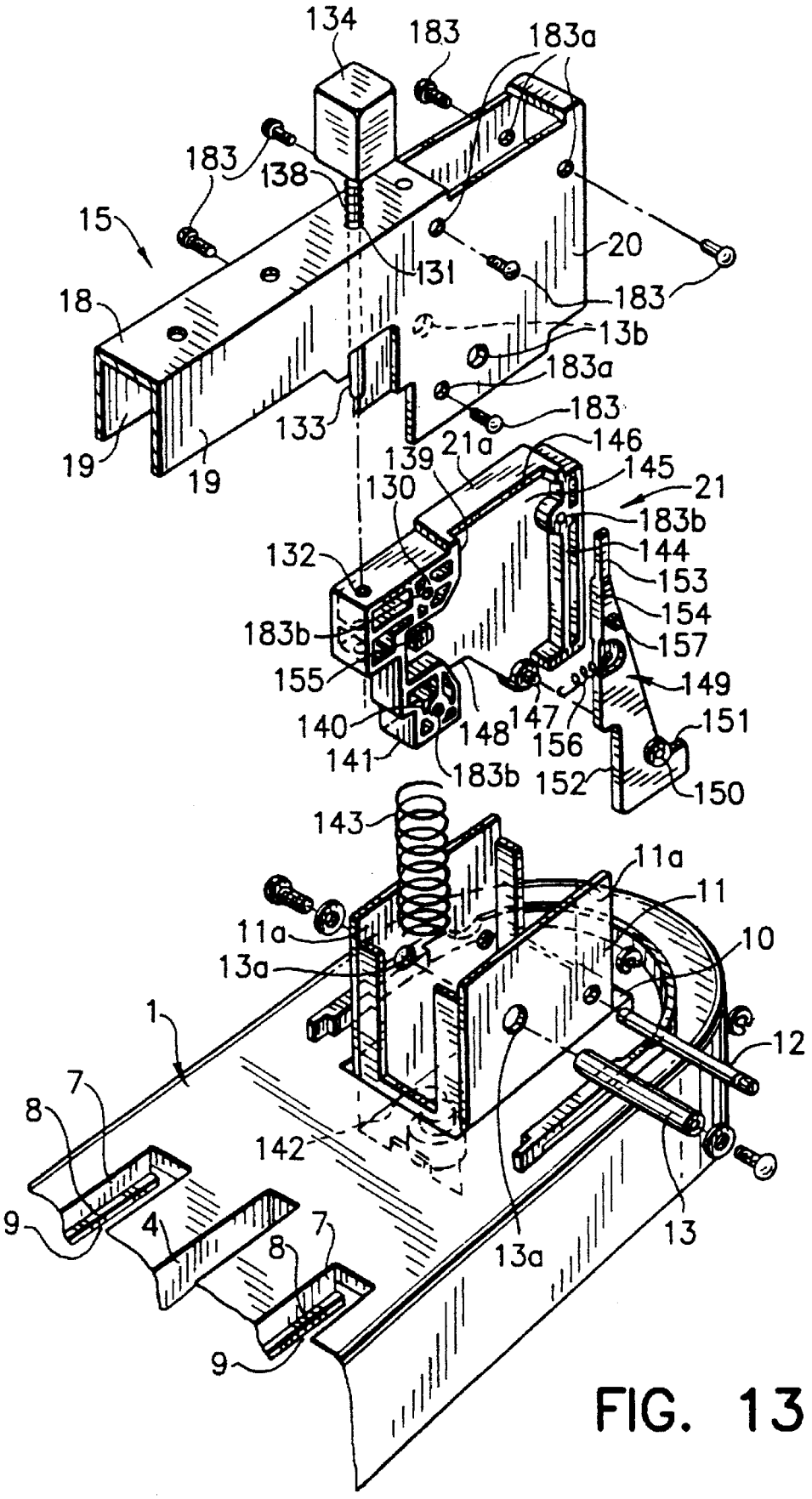
FIG. 13 is a fragmentary exploded perspective view of a base and mounting base according to the present invention.

Referring to FIGS. 3, 4, and 13, an integrally formed, molded synthetic resin block 21 is fixed between mounting bases 20. Block 21 includes a supporting member 130, a mounting member 140, and a partition 144, each of which includes a hole **183*b*. These holes 183*b* align with respective holes 183*a* in mounting base 20. Block 21 is fixed between mounting bases 20 by screws 183**, although other conventional fasteners can be used.

Top plate 18 includes a guide hole 131 for guiding an operating rod 133. At a top of operating rod 133 is a push button 134. A coil spring 138 between push button 134 and top plate 18 biases operating rod 133 upwards. Supporting member 130 of block 21 includes a through hole 132 so that operating rod 133 passes through block 21. Upward movement of operating rod 133 is arrested by a stopper 137 which engages a lower surface 136 of supporting member 130.

A top plate **21*a* of block 21 is planar with top plate 18. A guide groove 146 is formed in top plate 21*a* for permitting a pointer 153 of an indicator plate 149 to protrude therefrom. Indicator plate 149 is preferably made of a synthetic resin. A base 141 of mounting member 140 abuts coil spring 143. Coil spring 143 biases block 21 and therefore operating arm 15 upwards. Coil spring 143 rests on a base 142 which is formed on base body 1. A spring force of coil spring 143 must be less than the spring force of spring 48 to ensure proper operating of stapler 182**.

Partition 144, supporting member 130, and mounting member 140 define a housing recess 145. Housing recess 145 receives indicator plate 149 and permits rotational of indicator plate 145 therein. An insertion hole 150 in indicator plate 149 fits over a shaft 147 integrally formed at a lower side of block 21, thus rotably attaching block 21 to indicator plate 149. A recess 152 in indicator plate 149 and a clearance recess in block 21 prevent interference or contact with rotational shaft 13. A coil spring 156 connecting an upper portion of indicator plate 149 with a protrusion 155 protruding from block 21 biases indicator plate 149 counterclockwise about shaft 147. A catching ridge 151 projects horizontally rearward behind insertion hole 150, thereby abutting stopper 12 and limiting the relative counterclockwise rotation of indicator plate 149. A vertical abutting surface 154 at the upper front end of indicator plate 149 abuts a stopping portion 139 of supporting member 130, also limiting the relative counterclockwise rotation of indicator plate 149. A pair of guides 157 laterally projecting from indicator plate 149, preferably integrally formed with indicator plate 149, laterally guide the upper portion of indicator 149 between a side of block 21 and a side of mounting base 20.

Figure 11:
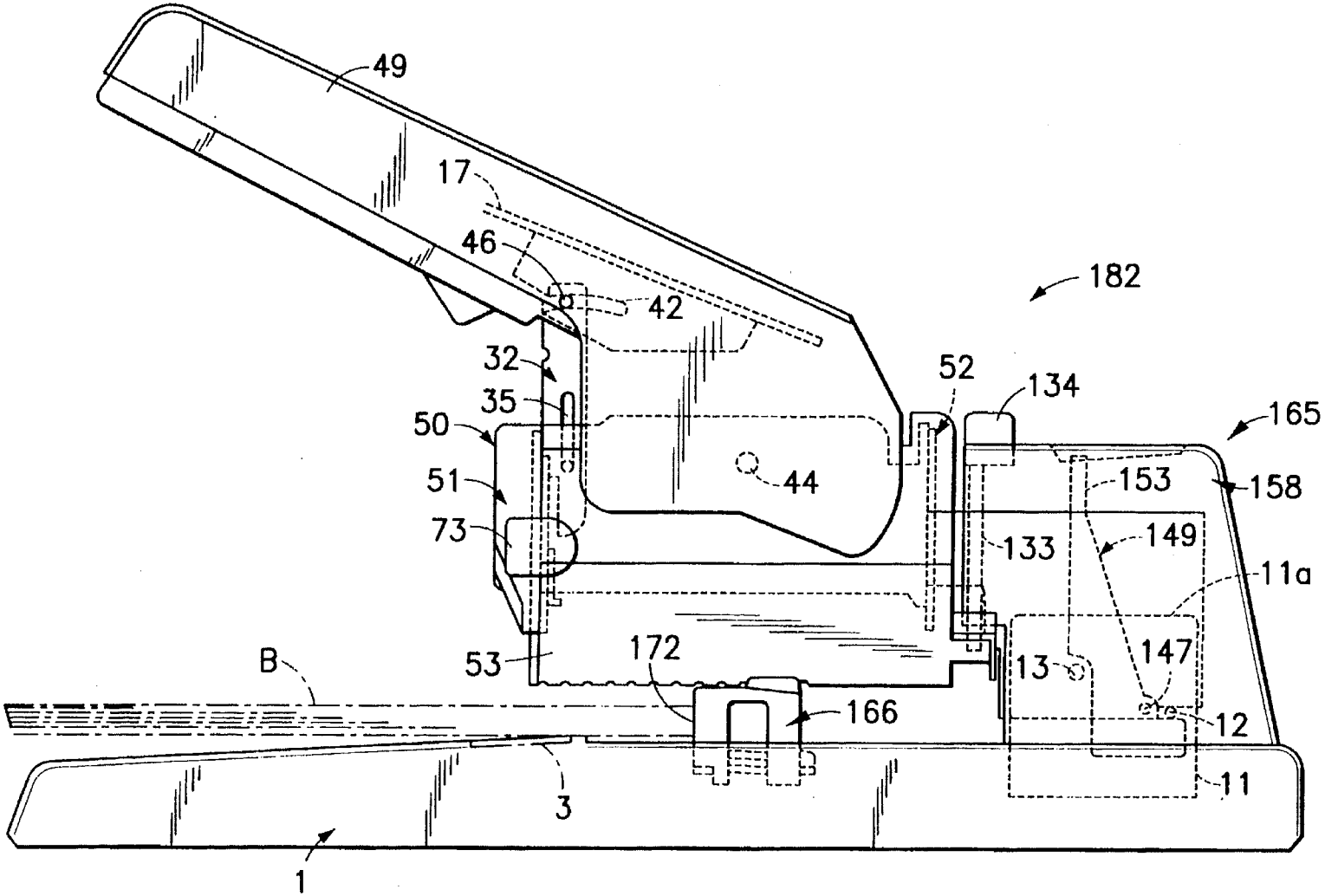
FIG. 11 is a side elevation view of a stapler according to an embodiment of the present invention.

Referring also to FIG. 11, a cover assembly 158 attaches to a rear of body base 1 to cover mounting bases 20, block 21, and indicator plate 149. Cover assembly 158 is preferably made of synthetic resin. Cover assembly 158 includes a housing recess 159 for accommodating push button 134. A recess 160 contains a guide groove 161 for receiving pointer 153. Three display panels 162, 163, and 164 of an indicator assembly 165 are disposed alongside guide groove 161. A position of pointer 153 relative to display panels 162, 163, and 164 indicates a length of a staple required to staple a stack of paper. For example, if staple strips contained in staple container 50 are 15 mm, 10 mm, and 6 mm, respectively, then these staple sizes are represented by display panels 162, 163, and 164.

As operating arm 15 rotates counterclockwise around rotational shaft 13, catching ridge 151 of indicator plate 149 contacts stopper 12 from below, thereby preventing indicator plate 149 from rotating along with operating arm 15 and block 21. Since stopper 12 is fixed with respect to body base 1, rotating operating arm 15 counterclockwise causes a relative clockwise movement of indicator plate 149 with respect to block 21 and cover assembly 158. Pointer 153 thus moves through guide groove 161 along display panels 162, 163, and 164.

The relation between pointer 153 and display panels 162, 163, and 164 is directly proportional to a vertical distance traveled by a forward edge of operating arm 15 as it rotates around rotational shaft 13. Operating arm 15 continues to rotate until staple container 50 contacts either the object to be stapled or anvil plate 3. When staple container 50 contacts the object to be stapled, pointer 153 indicates, by pointing to one of display panels 162, 163, and 164, the proper size staple to be used. When operating handle 17 is released by the user, operating arm 15 rotates clockwise to its original position around rotational shaft 13 due to the spring force of coil spring 143.

Referring to FIGS. 1–3 and 12, a suspension rod 29 rotatably connects staple container 50 to mounting frame 16. Mounting frame 16 includes a rear plate 28 which is preferably integrally formed with mounting frame 16. Suspension rod 29 extends through and is supported by rear plate 28 on a rearward end of mounting frame 16, and extends through and is supported by a supporting ridge 27 on a forward end of mounting frame 16. Staple container 50 includes a supporting member 52, which includes a hanging plate 82, and a guide plate 54, both of which depend from suspension rod 29, thus permitting staple container 50 to rotate laterally about suspension rod 29.

A vertical guide groove 30 is formed on either side of supporting ridge 27 for permitting vertical movement of two side plates 33 of an elevating frame 32. Each side plate 33 includes a vertical guide groove 35 of sufficient length to permit stapling action. A guide rod 31, passing through guide grooves 35, extends through mounting frame 16 below suspension rod 29 and at right angles to it. Each side plate 33 also includes an insertion hole 45 near an upper end.

Operating handle 17 includes a reinforcing member 39 in an area above coil spring 48 and elevating frame 32. Operating handle 17 and reinforcing member 39 are preferably made of metal, although any material having sufficient strength may be used. Side plates 40 of reinforcing member 39 fit inside side plates 41 of operating handle 17. A sliding shaft 46 extends through two arcuate guide grooves 42 in side plates 40 and side plates 41. Guide grooves 42 guide operating handle 17 along sliding shaft 46 when operating handle 17 is actuated.

Stopper 43 is preferably formed by notching and bending a rear portion of reinforcing member 39. Coil spring 48 continuously biases operating handle 17 upward with rotational shaft 44 acting as a fulcrum. Operating handle 17 pulls elevating frame 32 upward so that a bottom of guide grooves 35 engage guide rod 31. A synthetic resin cover 49 covers an upper side of operating handle 17.

Figure 7:
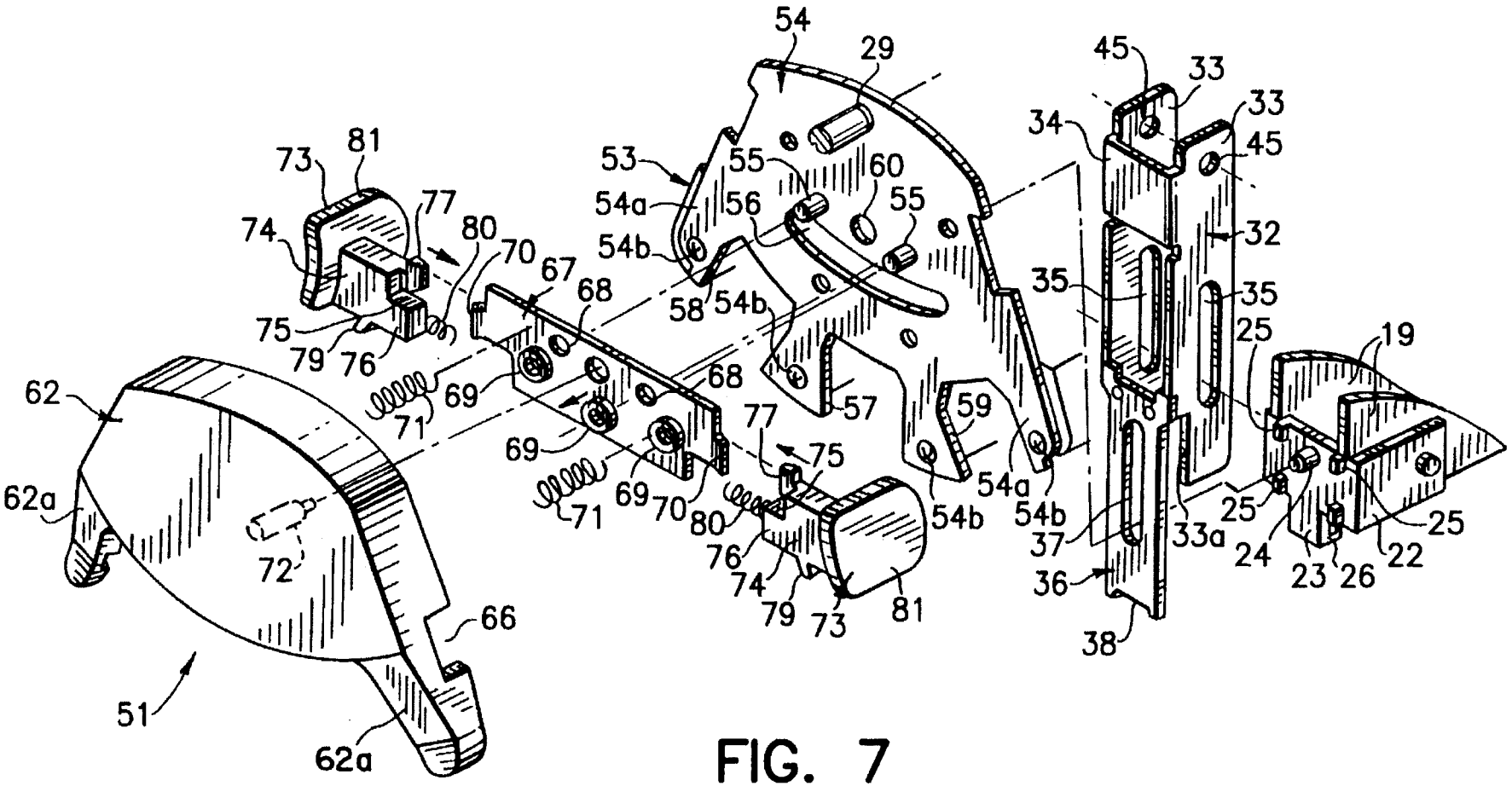
FIG. 7 is an exploded fragmentary perspective view of the staple container according to an embodiment of the present invention.
Figure 8:
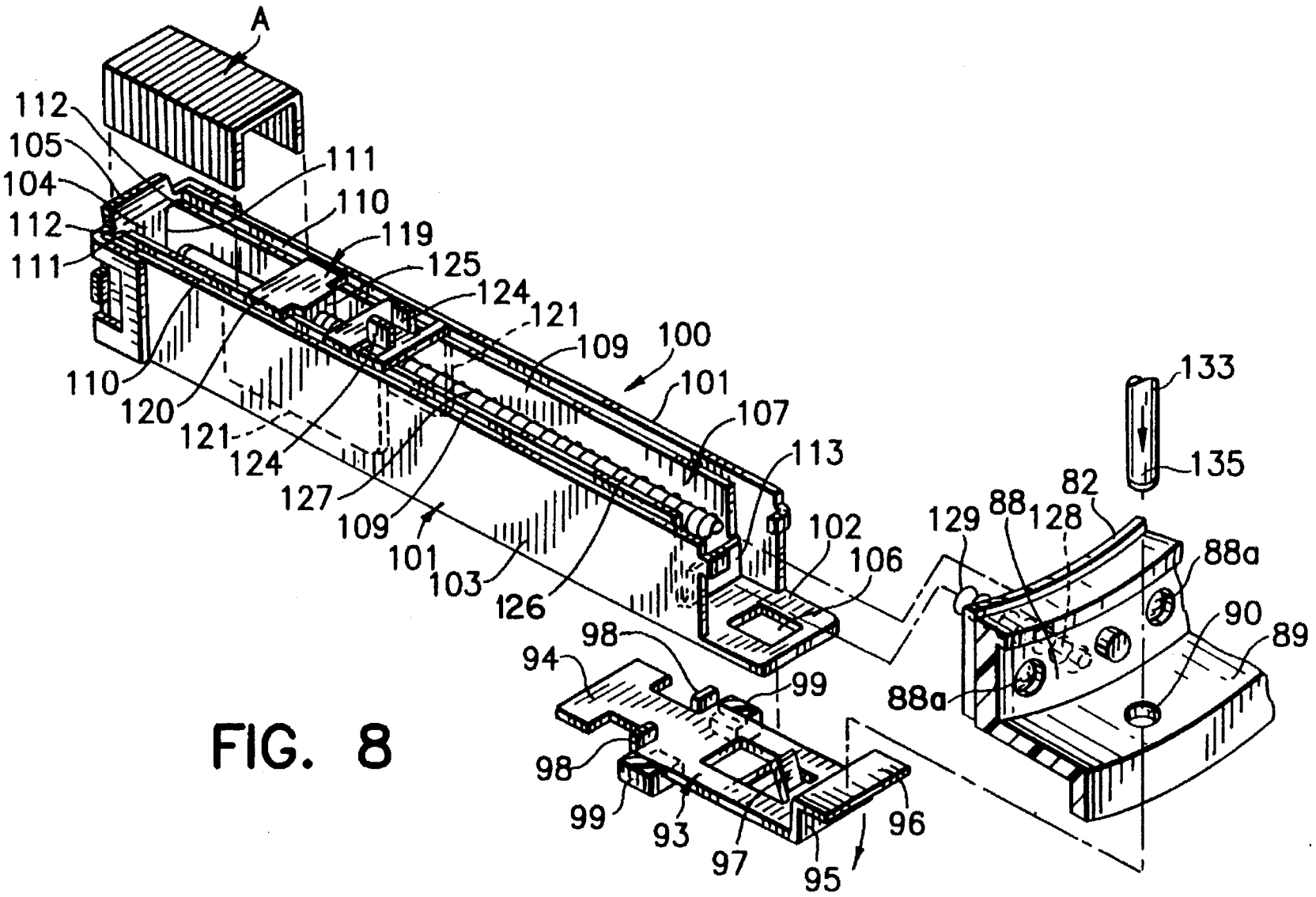
FIG. 8 is an exploded perspective view of a staple clip according to an embodiment of the present invention.
Figure 9:
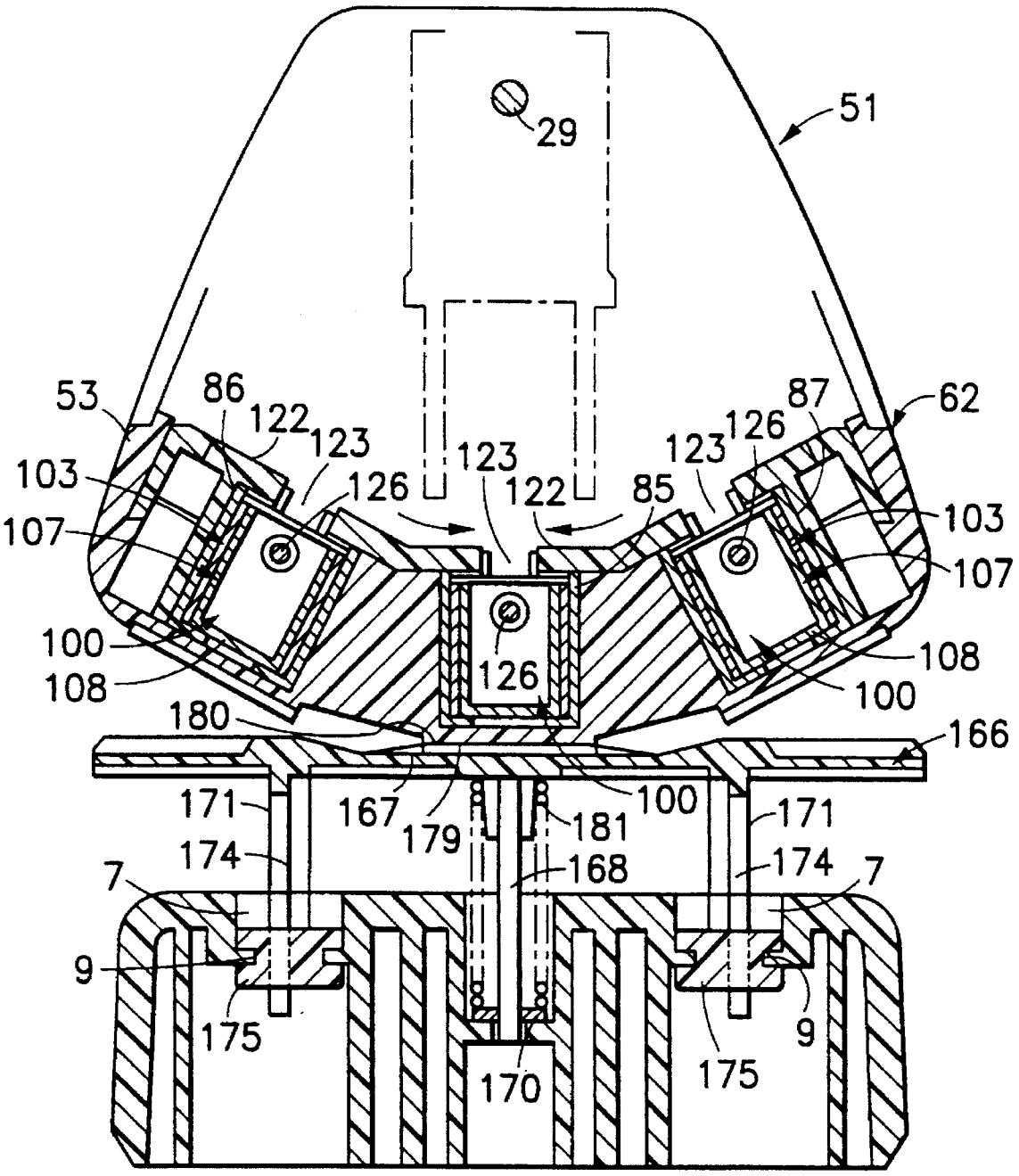
FIG. 9 is a cross-section view of the staple container and a stopper assembly according to an embodiment of the present invention.

Referring also to FIG. 7, elevating frame 32 includes a supporting piece 34 preferably integrally formed with side plates 33. A notch 33*a* is formed in a lower front edge of each side plate 33. A follow blade 36, which includes a guide groove 37 and a follow portion 38, is attached to side plates 33 just above notch 33*a*. A link 22 is connected to side plates 19 of operating arm 15. A lock pin 24 on a front face 23 of link 22 extends through guide groove 37. A front edge of lock pin 24 may be bevelled to improve operation. Four guides 25 on front face 23 guide follow blade 36 during its vertical movement. Notch 33*a* prevents side plates 33 from hitting front face 23 during vertical movement of elevating frame 32 and follow blade 36. Moving elevating frame 32 up and down moves follow blade 36 up and down along lock pin 24 and between guides 25. A portion of front face 23 is bent backward to form a guide piece 26. A bottom of guide piece 26 guides a leading section of a strip of staples A during the stapling process.

Referring to FIGS. 5–7 and 12, staple container 50 includes, as previously stated, hanging plate 82 and guide plate 54, both of which depend from suspension rod 29, thus permitting staple container 50 to rotate laterally about suspension rod 29. A magazine 53, connected to hanging plate 82 and guide plate 54, holds a plurality of staple clips 100. Each staple clip 100 holds a strip of staples A. Three staple clips 100 are depicted in this embodiment.

Guide plate 54 includes an arcuate guide groove 56 for receiving lock pin 24 of link 22. The arcuate shape permits the lateral rotation of staple container 50 about suspension rod 29. An insertion hole 60 in guide plate 54 allows a guide pin 72 on a cover assembly 62 to extend through guide plate 54 and guide groove 37 of follow blade 36. Two guide pins 55 protrude frontwards from guide plate 54 through two insertion holes 68 in a lock plate 67. A plurality of guide recesses 57, 58, and 59 provide space for an equal number of staple clips 100. A plurality of projecting portions 54*a* surrounding each guide recess 57, 58, and 59 include holes (not shown) for a plurality of screws 54*b* that connect guide plate 54 to magazine 53. Four screws 61 connect guide plate 54 to cover assembly 62.

A supporting member 51 includes cover assembly 62. A pair of covering members 62*a* project downward diagonally from the lower corners of cover assembly 62. Covering members 62*a* are preferably integrally formed with cover assembly 62 to cover the front of projecting portions 54*a* on each side of guide plate 54. A pair of guide recesses 66 are located at the lateral sides of cover assembly 62.

Cover assembly 62, preferably made of synthetic resin, includes a plate housing 63 which includes a plate housing recess 63*a* for receiving lock plate 67. A pair of partition pieces 64 abut lower corners of plate housing 63, forming a pair of spring housing recesses 65. Lock plate 67 fits snugly in plate housing recess 63*a*. Although lock plate 67 is constrained from moving side to side, it can move forward and backward. A pair of coil springs 71, disposed laterally inside plate housing recess 63*a* between cover assembly 62 and lock plate 67, continuously bias lock plate 67 towards guide plate 54. Movement of lock plate 67 is limited by guide pin 72 projecting rearward from cover assembly 62 through insertion hole 60 of guide plate 54. Lock plate 67 includes three laterally spaced lock holes 69 for selectively engaging lock pin 24 of link 22.

A pair of cam pieces 70 project diagonally forward at a prescribed angle from both ends of lock plate 67. A pair of operation buttons 73 include a curved operating member 81 on one end and a rectangular sliding portion on another end. Rectangular sliding portion 74 fits through guide recesses 66. On an end of each sliding portion 74 is a catching shoulder 76, a cam 77, and a notched channel 75 therebetween. Each notched channel 75 corresponds to partition pieces 64 of plate housing 63, thereby allowing operating buttons 73 to slide over partition pieces 64 when pressed into guide recesses 66. Two coil springs 80 on each catching shoulder 76 fit into each spring housing recess 65 and keep operation buttons 73 normally biased outward. Two protrusions 79 on a lower surface of each sliding portion 74 keep sliding portions 74 inside cover assembly 62. An upper edge of each cam 77 protrudes upwards sliding portions of sliding portions 74. A back side of this upper edge abuts a stepped portion 78 of each guide recess 66 when operation buttons 73 are biased outward. Lateral pressure on both curved operating members 81 moves operation buttons 73 laterally inward towards each other. Lateral pressure is applied with a single hand of the user, using a thumb and any other finger.

When operation buttons 73 are depressed against coil springs 80, cams 77 push cam pieces 70 forward away from guide plate 54. Cam pieces 70 move lock plate 67 away from guide plate 54 against the force of coil springs 71 until the engaged lock hole 69 disengages lock pin 24. Staple container 50 is now free to rotate. The user continues to hold operation buttons 73 depressed with thumb and finger while rotating staple container 50 around suspension rod 29 until the appropriate staple clip 100 is selected and positioned.

Once staple container 50 is positioned, the user releases operation buttons 73. The spring force of coil springs 80 urges operation buttons 73 outward. Cams 77 disengage from cam pieces 70, thereby permitting coil springs 71 to move lock plate 67 on guide pins 55 toward guide plate 54. Lock pin 24 fits into the lock hole 69 corresponding to the selected staple clip 100. Lock pin 24 thereby locks staple container 50 in the prescribed position.

Referring to FIGS. 3, 8–9, and 12, hanging plate 82 is rotably supported by suspension rod 29. A plastic cover 83 connected to an upper edge of hanging plate 82 covers a rear face of hanging plate 82. Guide holes 84 in hanging plate 82 and cover 83 allow cover 83 and hanging plate 82 to rotate around the outside of operating arm 15. A bottom portion of hanging plate 82 connects to magazine 53. Magazine 53 contains three staple clip cases 85, 86, and 87. Staple clip cases 85, 86 and 87 fit into guide recesses 57, 58, and 59, respectively.

A block plate 88 is secured to the bottom portion of hanging plate 82 by screws 88*a*. Block plate 88 closes a collective rear of staple clip cases 85, 86, and 87. A catching ledge 89, integrally formed with block plate 88, projects rearward. Three guide holes 90 in catching ledge 89 correspond to staple clip cases 85, 86, and 87. Operating rod 133 is aligned with the guide hole 90 corresponding to that staple clip case 85, 86, 87 that has its staple clip 100 in the selected position for stapling. A laterally elongated hole 92 is formed in the fore and aft direction where each staple clip case 85, 86, and 87 connects to block plate 88.

Each of staple clip cases 85, 86, and 87 receives a staple clip 100, wherein each of staple clips 100 holds a different size staple. It is equally within the contemplation of the invention that two or more staple clips 100 accommodate the same size staple, thereby extending the supply of staples available.

Staple clip 100 includes a U-shaped clip body 103 consisting of a pair of parallel side plates 101 connected by a base plate 102. Clip body 103 is preferably integrally formed of metal. A guide plate 104 at a front end of clip body 103 guides a punched staple downward. A guide piece 105 at an upper end of guide plate 104 inclines forward. A stopper hole 106 is in a rear portion of base plate 102 that extends beyond side plates 101.

A rail 107 extends fore and aft within clip body 103. Rail 107 includes a pair of parallel guide rails 109 and a movable base plate 108. Rail 107 is movable within clip body 103. A staple containing section 110, which supports the tines of staples A, is defined by a space between guide rails 109 and side plates 101. An upper front end of each guide rail 109 is chamfered to form a guide 112. A remainder of the front end of each guide rail 109 forms an abutting surface 111. A punched staple is guided downward by abutting surface 111 and guide plate 104. An abutting projection 113 at a rear of movable base plate 108 closes a lower portion of rail 107 to add rigidity to the structure.

A slider 119 slides along guide rails 109. Slider 119 is an inverted U-shape including a horizontal portion 120 and a pair of vertical portions 121. A supporting piece 125 projects downward from a middle of horizontal portion 120. A guide rod 126 extends through staple clip 100 and is attached to block plate 88 at one end. Another end passes through a hole in supporting piece 125. A coil spring 127 on guide rod 126 extends between block plate 88 and supporting piece 125, thereby biasing slider 119 forward. A front edge of horizontal portion 120 slides against strip of staples A, thereby urging a forwardmost staple against guide piece 105.

A pair of sliding pieces 124 project upward from a rear of horizontal portion 120. Sliding pieces 124 slide along a guide channel 123 in a top portion 122 of each staple clip case 85, 86, and 87 in magazine 53.

Three connector protrusions 128, one for each of staple cases 85, 86, and 87, protrude forward from block plate 88. Each connector protrusion 128 has a coil spring 129 wound on it which abuts projection 113, thereby biasing its corresponding staple clip 100 forward.

Three lock plates 93 are attached to a base portion 91 of magazine 53 underneath each staple clip case 85, 86, and 87. Each lock plate 93 has a fixed portion 94 extending from its front end which is attached to base portion 91. A rear portion of lock plate 93 includes a vertical portion 95 and a horizontal release piece 96. The release piece 96 corresponding to that staple clip case 85, 86, 87 that has its staple clip 100 in the selected position for stapling is aligned with that guide hole 90 corresponding to that staple clip case. Operating rod 133 is thus aligned with that release piece 96.

A stopper 97, preferably formed by cutting and pushing up a portion of lock plate 93, is between release piece 96 and fixed portion 94. When staple clip 100 is inserted into magazine 53, base plate 102 pushes against stopper 97 and bends it out of the way. As staple clip 100 is pushed further, stopper 97 slips into stopper hole 106 to lock staple clip 100 in place. A pair of insertion pieces 98 on lock plate 93 engage the lower surface of base portion 91. A pair of protrusions 99, on the upper surface of base 91 adjacent to insertion pieces 98, sandwich and support lock plate 93.

In order to load new staples into staple clip 100, the user rotates staple container 50 until the desired staple clip 100 is selected. This has the effect of aligning the corresponding guide hole 90 in catching ledge 89 with operating rod 133. Push button 134 is depressed which forces a pushing portion 135 of operating rod 133 through guide hole 90 and against release piece 96. Stopper 97 is thus dislodged, and the biasing force of coil spring 129 against abutting projection 113 moves staple clip 100 forward so that it can be grasped by the user and manually removed from magazine 53.

Figure 2:
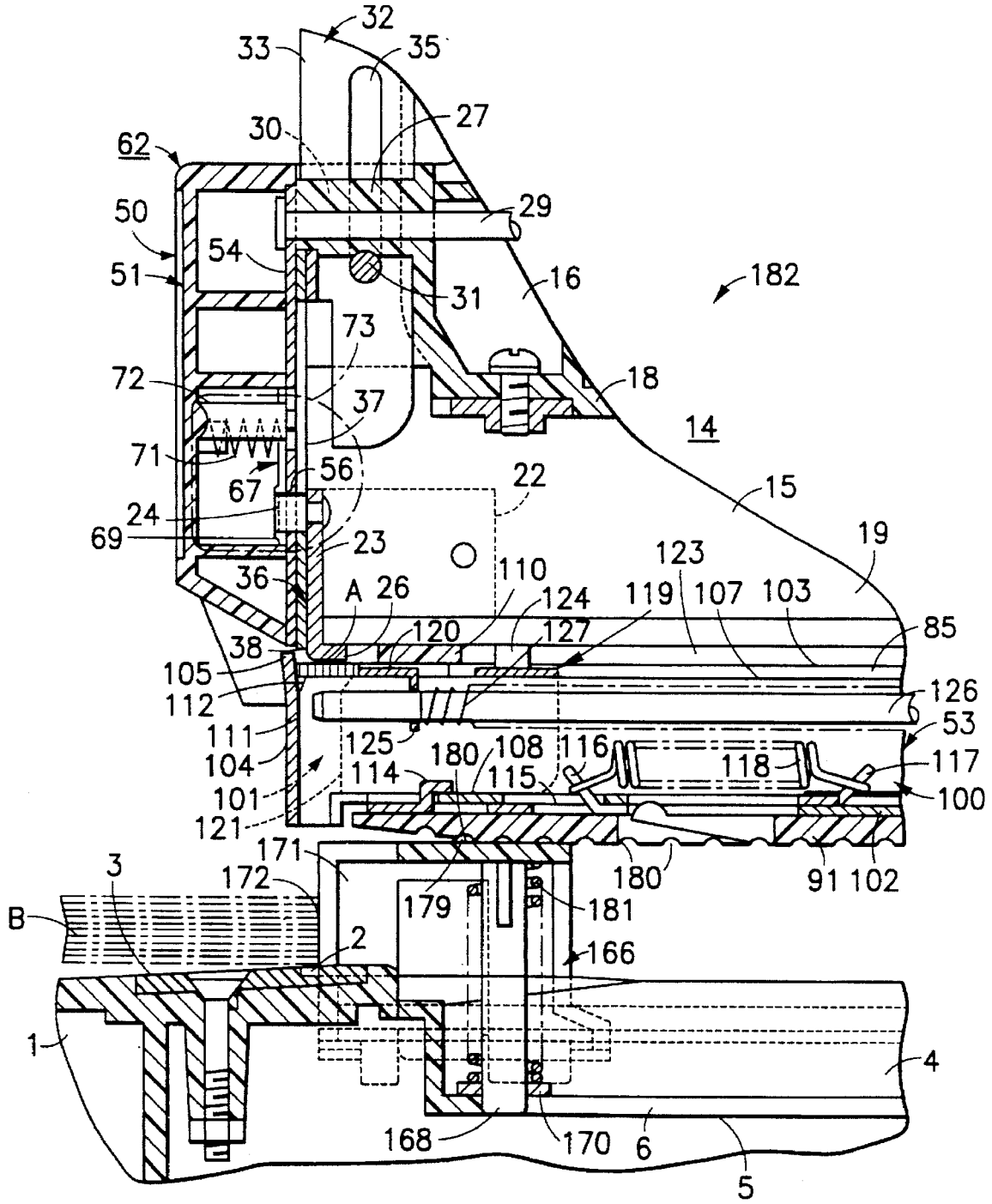
FIG. 2 is an enlarged partial cross-section view of a front portion of the stapler of FIG. 1.

Referring to FIGS. 1–3, a stopper protrusion 114 extends upward from base plate 102 to limit forward movement of a front end of movable base plate 108. A front mounting piece 116 is formed by cutting and bending upward a portion of base plate 102 through a guide hole 115, as is a rear mounting piece 116 formed near a rear portion of base plate 102. Rear mounting piece 116 also projects through a guide hole 115. A rear mounting piece 117 projects upward from movable base plate 108. A coil spring 118 stretches between mounting pieces 116 and 117 to bias rail 107 toward stopper protrusion 114 of base plate 102. The front end of guide rails 109 abuts guide plate 104 and the rear edge of guide hole 115 abut rear mounting piece 116. Rear mounting piece 116 prevents movable base plate 108 from being pulled away from base plate 102 by the force of coil spring 118.

Figure 10:
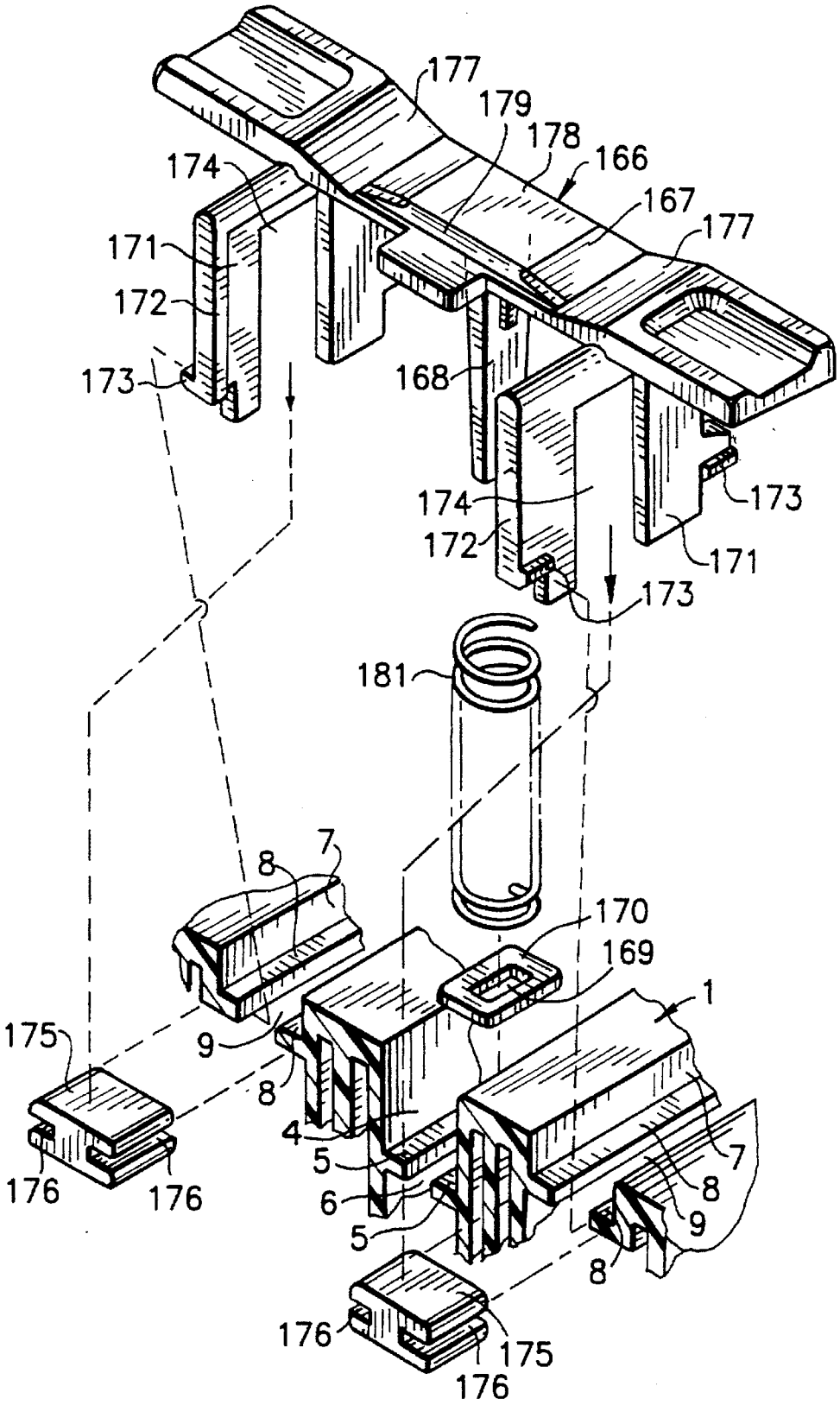
FIG. 10 is an exploded perspective view of the stopper assembly according to an embodiment of the present invention.

Referring now to FIGS. 2 and 10, a stopper assembly 166 positions a stack of paper for stapling. As paper is inserted into stapler 182, a stopper 172 on stopper assembly 166 limits and determines a degree of insertion. Stopper assembly 166 includes a horizontal abutting plate 167 connected to two vertical sliding plates 171 and a vertical supporting plate 168. Supporting plate 168 extends downward, through a guide hole 169 in a sliding piece 170, into a guide channel 6 of body base 1. A coil spring 181 over supporting plate 168 extends between sliding piece 170 and a lower surface of abutting plate 167. Coil spring 181 biases stopper assembly 166 upwards.

Guide channel 6 is bounded on both sides by two guide plates 5, thus forming a guide recess 4. Sliding piece 170 slides over guide plates 5 as supporting plate 168 moves back and forth along guide channel 6. Two slide channels 9 in body base 1, on either side of and parallel to guide channel 6, are each bounded by two slide plates 8. Two slide recesses 7 are formed by slide plates 8 and body base 1. A front portion of each sliding plate 171 includes stopper 172. Two ridges 173 on a lower edge of front and back portions of each sliding plate 171 fit underneath each slide plate 8 for limiting upward movement of stopper assembly 166.

Two braking members 175 fit into slide channels 9. Braking members 175 are I shaped, with a catching groove 176 in each side for engaging slide plates 8. Two guide recesses 174 in sliding plates 171 fit over braking members 175 for preventing stopper assembly 166 from tilting forward or backward when operating assembly 14 rotates around rotational shaft 13.

A catching ridge 179 extends laterally across an upper front portion of abutting plate 167 for engaging a one of a plurality of catching grooves 180 formed in a lower surface of magazine 53. A nearly horizontal abutting portion 178 extends across a remainder of abutting plate 167. Two guide slopes 177 extend from ends of abutting plate 167 for guiding lateral movement of magazine 53 as magazine 53 rotates around suspension rod 29.

Stopper assembly 166 is repositioned by pressing stopper assembly 166 downward against the force of coil spring 181 while urging stopper assembly 166 forward or backward. Supporting plate 168 moves sliding piece 170 along guide plates 5, while sliding plates 171 move braking members 175 along slide plates 8. Thus, stopper assembly 166 is smoothly adjustable to a desired position.

As operating assembly 14 rotates around rotational shaft 13, the lower surface of magazine 53 pushes against stopper assembly 166. A direction of this push depends on the fore and aft position of stopper assembly 166 as well as a thickness of the stack of paper B being stapled. Braking members 175 resist forward and backward movement of stopper assembly 166 in addition to the tilting of stopper assembly 166. Therefore, stopper assembly 166 only moves vertically during the stapling operation, regardless of where it is positioned. Stoppers 172 thus are always perpendicular to an edge of stack of paper B during stapling.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined the appended claims.

What is claimed is:

1. A stapler, comprising:

means for driving a staple;

means for determining a properly sized staple to penetrate and staple an object;

means for selecting said properly sized staple from a magazine containing at least two differently sized staples;

a stopper assembly;

said stopper assembly being held in a first base of said stapler;

said first base including a plurality of grooves;

said grooves aligned with said magazine;

means for trapping said stopper assembly in said grooves;

said determining means and said stopper assembly being free from interference with each other;

means for slidably engaging said stopper assembly with a second base of said magazine of said stapler throughout a length of said second base;

said stopper assembly including a catching ridge;

said catching ridge engaging one of a plurality of catching grooves in said second base; and means for maintaining said stopper assembly in a vertical position during a stapling operation.

2. An apparatus according to claim 1, wherein said stopper assembly comprises:

an abutting plate;

two sliding plates connected perpendicularly to said abutting plate;

a supporting plate connected perpendicularly to said abutting plate; and said supporting plate being between said sliding plates.

3. A stapler, comprising:

means for driving a staple;

means for determining a properly sized staple to penetrate and staple an object;

means for selecting said properly sized staple from a magazine containing at least two differently sized staples;

a stopper assembly; said stopper assembly comprising an abutting plate, two sliding plates connected perpendicularly to said abutting plate, a supporting plate connected perpendicularly to said abutting plate, and said supporting plate being between said sliding plates;

said determining means and said stopper assembly being free from interference with each other;

means for slidably engaging said stopper assembly with a base of said stapler;

means for maintaining said stopper assembly in a vertical position during a stapling operation; and said means for maintaining said stopper assembly in a vertical position during a stapling operation comprising two braking members, each of said sliding plates including a recess for receiving one of said braking members, and each of said braking members slidably engaging said base of said stapler.

* * * * *